United States Patent [19]

Wagner

[11] 4,090,584

[45] May 23, 1978

[54] SAFETY BRAKE

[76] Inventor: Nick J. Wagner, 289 Jupiter Dr., Cincinnati, Ohio 45238

[21] Appl. No.: 807,346

[22] Filed: Jun. 17, 1977

[51] Int. Cl.[2] ..... B65H 59/16

[52] U.S. Cl. ..... 182/5; 188/65.1

[58] Field of Search ..... 182/3, 5, 6, 7; 188/65.1, 65.2, 65.4

[56] References Cited

U.S. PATENT DOCUMENTS

| | | | |
|---|---|---|---|
| 1,103,849 | 7/1914 | Stenborg | 182/5 |
| 2,172,094 | 9/1939 | Voigt | 188/65.1 |

FOREIGN PATENT DOCUMENTS

| | | | |
|---|---|---|---|
| 1,262,848 | 3/1968 | Germany | 182/5 |

*Primary Examiner*—Reinaldo P. Machado
*Attorney, Agent, or Firm*—Melville, Strasser, Foster & Hoffman

[57] ABSTRACT

A single piece safety brake having no moving parts for attachment between a safety line secured to a structure and a safety belt line worn by an aerial workman to prevent falls by the workman. The brake comprises a hollow helical guide member with an arcuate axis adapted to permit the safety line to be passed therethrough. A connecting eyelet may be located at one end of the guide member for connecting the safety belt line thereto. A serrated opening having inwardly projecting teeth is provided opposite the eyelet for exerting a drag on the safety line. The brake may be placed at any position on the safety line and easily moved there along by the workman. A downward force applied to the eyelet causes the brake to assume a substantially horizontal position, bringing the inwardly projecting teeth into contact with the safety line to exert a drag thereon and prevent downward movement of the brake along the safety line.

4 Claims, 4 Drawing Figures

SAFETY BRAKE

BACKGROUND OF THE INVENTION

1. Field of the Invention

The present invention relates to safety devices for preventing falls by aerial workman and more particularly to a single piece safety brake for attachment between a safety line secured to a structure and a safety belt line worn by an aerial workman to prevent falls by the workman.

2. Description of the Prior Art

Safety devices for preventing falls by workman, such as window washers and construction personnel, from elevated scaffolding are well known and widely utilized in the construction and maintenance trades. Many of these devices operate in conjunction with a safety line secured to a dependable part of the structure upon which work is being performed, such as the roof or an overhanging ledge, to limit the distance that the workman may fall.

One type of safety device commonly employed with such a safety line comprises a brake which securely engages the line to prevent downward movement. Such brakes, while being widely used in the industry, have presented several disadvantages which have heretofore hindered their utility.

For example, certain brakes employ complex mechanical mechanisms which are subject to wear and maintenance problems, resulting in possible mechanical failure and unreliability. Other brakes, because of their size and weight, are difficult for the workman to move along the safety line as he ascends or decends in his work. This additional distraction of the workman's attention can lead to an increased chance for a fall or other industrial accident. Finally, prior art safety brakes may require disassembly of the safety line structure so that the brake can be connected to the line.

SUMMARY OF THE INVENTION

The safety brake of the present invention seeks to overcome many of the limitations of prior art safety brakes by providing a simplified, single piece safety brake having no moving parts for attachment between a safety line secured to a structure and the safety belt worn by an aerial workman. In general, the brake comprises a hollow helical guide member with an arcuate axis adapted to permit the safety line to be passed therethrough. This construction permits the brake to be placed on the line in any position and easily moved therealong by the workman as he ascends or descends.

The brake also includes a connecting eyelet which may be located at one end of the brake for connecting the safety belt line of the workman thereto. A serrated opening having inwardly projecting teeth is provided opposite the eyelet for exerting a drag on the safety line in the case of a fall. During such a fall, a downward force is applied to the eyelet through the safety belt line causing the brake to assume a substantially horizontal position, thereby bringing the serrated teeth into contact with the safety line to exert a drag on the line and prevent further downward movement of the brake alon the line. Hence, the downward movement of the workman is arrested preventing potentially serious injury.

An additional eyelet connector may be added near the lower end of the brake to which a short length of rope may be attached so that the brake may be easily moved along the safety line by the workman to any convenient position. Attachment to the eyelet may be made by snap hooks or any other convenient fastener.

DESCRIPTION OF THE PREFERRED EMBODIMENTS

Figure 2:
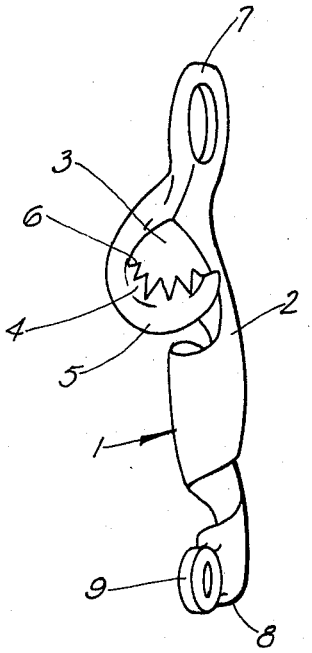
FIG. 2 is a perspective view of the safety brake of the present invention.
Figure 3:
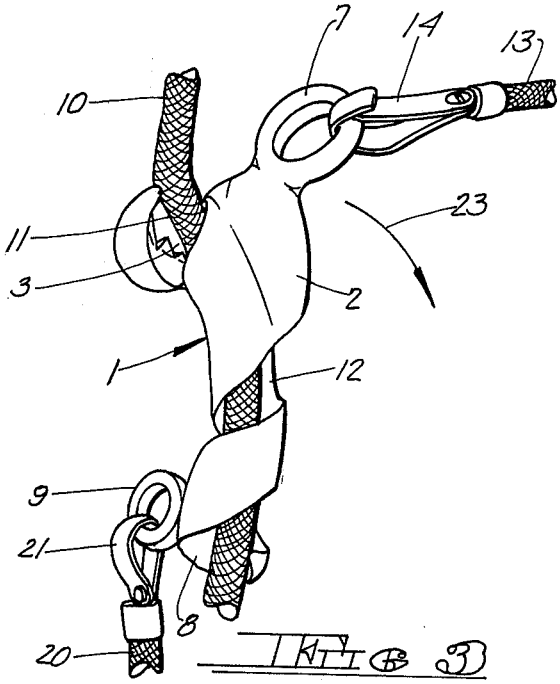
FIG. 3 is a fragmentary perspective view of the safety brake of the present invention showing the safety line, safety belt line and auxiliary guide rope connections, with the brake in the normal operating configuration.

The safety brake of the present invention is shown generally at 1 in FIG. 2. The brake comprises a hollow helical guide member 2, having an arcuate axis, as is best shown in FIG. 3. As shown in FIG. 2, the upper end of guide member 2 terminates in an inlet opening 3. Rope engaging means 4 are located adjacent opening 3 and comprise a serrated cusp 5 having a plurality of inwardly projecting teeth 6.

A connecting eyelet 7 is formed as an integral part of guide member 2 and is located adjacent opening 3 and opposite rope engaging means 4. Eyelet 7 may be used to connect a suitable safety belt line to an aerial workman, as will be explained in more detail hereinafter.

As shown in FIG. 2, the lower end of helical guide member 2 terminates in an outlet opening 8. A second eyelet 9 is located adjacent outlet 8 for connecting to an auxiliary guide rope, the function and construction of which will be explained hereinafter.

Turning now to FIG. 3, the attachment of safety brake 1 to a typical safety line will be explained in detail. Safety brake 1 is oriented parallel to safety line 10 so that the brake is essentially vertical and upper connecting eyelet 7 is positioned above lower connecting eyelet 9. Safety line 10 is inserted into opening 11 of inlet 3, and the entire brake rotated in a counter clockwise direction as viewed from above until safety line 10 completely passes through the hollow opening 12 of helical guide member 2 with the lower end of safety line 10 immerging from outlet 8. Using this procedure, it will be understood that brake 1 may be inserted at any place along safety line 10 without the need to disconnect either end of the line.

Having thus positioned brake 1 on the line 10 in the desired location, a suitable safety belt line, a portion of which is shown at 13, may be connected to connecting eyelet 7 by any suitable fastening means, such as snap hook 14.

Figure 1:
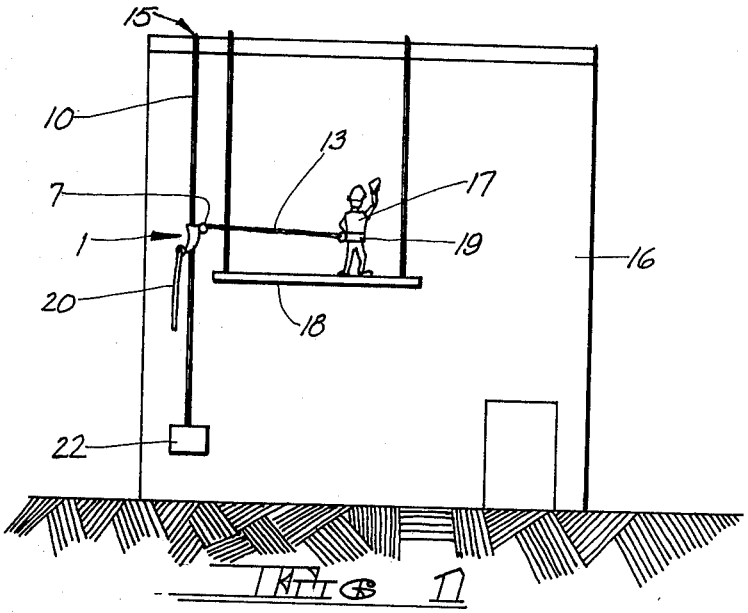
FIG. 1 is a pictorial representation of the safety brake of the present invention in use in a typical working environment.

The completed safety brake insulation is shown pictorially in FIG. 1. Safety line 10 is secured to a structurally reliable portion 15 of building 16 by any suitable fastening means. Safety line 10 is kept taut by a weight 22, such as a conventional concrete block, secured to the lower end of the line. Safety brake 1 is attached to line 10 at approximately the working elevation of workmen 17 as described hereintofore. As shown in FIG. 1, workman 17 may be supported by a separately secured scaffolding 18. Safety belt line 13 is securely attached to the workman's safety belt 19 at one end, and to connecting eyelet 7 located on brake 1 at the other, as described hereintofore. As can be seen, safety brake 1 will be free to move along safety line 10 as workman 17 ascends or decends.

An additional auxiliary guide rope, a portion of which is shown at 20 in FIG. 3, which may be of any convenient length, may be attached to lower connecting eye 9 by means of snap hook 21 or a similar fastener, to enable a workman to more easily slide brake 1 along safety line 10 as he ascends or decends the face of the structure.

As can be seen in FIG. 3, the arcuate shape of the central passage 12 of brake 1 imparts a slight bight to safety line 10 to produce a slight sliding friction between brake 1 and line 10. This slight sliding resistance permits brake 1 to maintain a desired position on line 10 with respect to workman 17, thereby preventing the brake 1 from sliding to a lower position on line 10 and hence becoming a burden to the workman. In addition, it will be observed that brake 1 will tend to maintain its relative vertical position on line 10 as workman 17 moves horizontally along scaffolding 18 during the course of his work.

Figure 4:
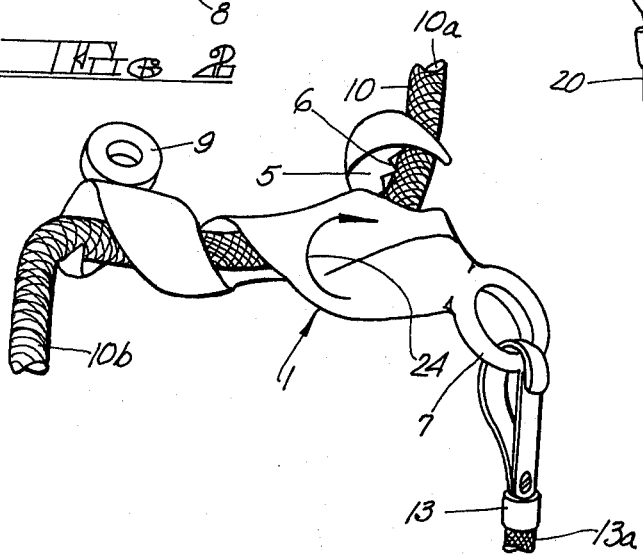
FIG. 4 is a fragmentary cut-away view of the safety brake of the present invention shown activated in a fall preventing position.

FIG. 4 illustrates the position of brake 1 on line 10 when the workman 17 has fallen from scaffolding 18. Line 10 is shown severed at points 10*a* and 10*b* for greater clarity. As before, it will be understood that severed end 10*a* continues to a point of attachment 15 near the top of building 16, while severed end 10*b* continues to a point of attachment to weight 22. It will be further understood that safety belt line 13, shown severed at 13*a* for convenience, continues to a point of attachment on safety belt 19. Finally, snap hook 21 attached to auxiliary guide line 20 has been deleted from FIG. 4 for clarity.

It will be observed that when a downward force is applied through safety belt line 13 to eyelet connection 7, such as might be produced by the fallen workmen, safety brake 1 will be cause to rotate in the direction shown by arrow 23 in FIG. 3, to assume the essentially horizontal position depicted in FIG. 4. In the fall-arresting position of FIG. 4, safety belt line 13 hangs substantially vertically due to the weight of the fallen workmen at its end. Likewise, the lower end of safety line 10 also assumes a substantially vertical position by reason of weight 22 attached to the lower end of line 10. It will be understood that the mass of weight 22 is such so that as to permit safety line 10 to assume the Z-shaped bight shown in FIG. 4.

The rotation of safety brake 1 to the position shown in FIG. 4 causes cusp 5 and the inwardly projecting teeth 6 associated therewith to engage the portion of safety line 10 passing adjacent thereto, thus preventing slippage of the brake 1 with respect to line 10, and arresting the fall of the workman. As long as a downward force continues to be exerted on connecting eye 7, the pivotal moment depicted by arrow 24 in FIG. 4 will continue to be produced, thereby continuing to urge teeth 6 against the outer surface of line 10. When the downward force has been removed on connecting eye 7, brake 1 may be returned to its normal upright position, as shown in FIG. 3, thereby permitting brake 1 to slide along line 10. It will be observed that while brake 1 insures a simple reliable method for arresting the downward motion of a fallen workman, damage to line 10 resulting from engagement with teeth 6 and cusp 5 is minimized, thereby permitting complete reusability of both brake and safety line.

It will be understood that various changes in the details, materials, steps and arrangements of parts, which have been herein described and illustrated in order to explain the nature of the invention, may be made by those skilled in the art within the principal and scope of the invention as expressed in the appended claims. For example, the particular configuration of helical guide member 2 may be altered as to size and number of turns forming the helix to accommodate specific types or sizes of safety lines. In addition, alternative connecting devices may be used in place of connecting eyelets 7 and 9, for example, threaded fasteners, etc.

I claim:

1. A safety brake for attachment between a safety line secured to a structure and a safety belt line worn by an aerial workman to prevent falls by the workman, said brake comprising a hollow arcuate axis helical guide member having an inlet and outlet located at opposite ends thereof and adapted to receive the safety line therethrough, connecting means adjacent said inlet for attaching to the safety belt line, and rope engaging means adjacent said inlet and said opposite connecting means for exerting a drag on the safety line, said brake being adapted to be placed at any location on the safety line with said inlet positioned above said outlet and to be moved by the workman therealong, said brake being adapted to pivotally assume a rope engaging position upon a downward force applied to said connecting means along the safety belt line whereby said engaging means may be caused to contact the safety line to exert a drag thereon for preventing downward movement of said brake along the safety line.

2. The safety brake according to claim 1 wherein said guide member includes connecting means adjacent said outlet for attaching to an auxiliary guide line for moving said brake to any position along the safety line.

3. The safety brake according to claim 2 wherein said connecting means comprise eyelets for accepting a snap hook therein.

4. The safety brake according to claim 1 wherein said rope engaging means comprises an arcuate cusp having a plurality of sharpened rope engaging teeth projecting inwardly of said cusp toward the safety line for engaging the line.

* * * * *